US011767778B1

(12) United States Patent
Choi et al.

(10) Patent No.: US 11,767,778 B1
(45) Date of Patent: Sep. 26, 2023

(54) UREA SOLUTION MIXING CHAMBER FOR DIESEL VEHICLE

(71) Applicants: Hyundai Motor Company, Seoul (KR); Kia Corporation, Seoul (KR); Faurecia Korea, Ltd., Yongin-si (KR)

(72) Inventors: Yoon Sung Choi, Hwaseong-Si (KR); Jae Yeol Yun, Osan-Si (KR); In Kyun Na, Hwaseong-Si (KR); Gyu Hwa Jeong, Suwon-Si (KR)

(73) Assignees: Hyundai Motor Company, Seoul (KR); Kia Corporation, Seoul (KR); Faurecia Korea, Ltd., Yongin-Si (KR)

( * ) Notice: Subject to any disclaimer, the term of this patent is extended or adjusted under 35 U.S.C. 154(b) by 0 days.

(21) Appl. No.: 17/946,835

(22) Filed: Sep. 16, 2022

(30) Foreign Application Priority Data

May 31, 2022 (KR) ..... 10-2022-0067149

(51) Int. Cl.
*F01N 3/08* (2006.01)
*F01N 3/20* (2006.01)

(52) U.S. Cl.
CPC ..... *F01N 3/0814* (2013.01); *F01N 3/2066* (2013.01); *F01N 2330/38* (2013.01); *F01N 2610/02* (2013.01); *F01N 2610/1453* (2013.01)

(58) Field of Classification Search
CPC .. F01N 3/0814; F01N 3/2066; F01N 2330/38; F01N 2610/02; F01N 2610/1453
See application file for complete search history.

(56) References Cited

U.S. PATENT DOCUMENTS

2012/0324872 A1* 12/2012 Jaruvatee ..... B01F 25/314 60/317
2016/0017780 A1* 1/2016 Kinugawa ..... F01N 3/021 60/286
2016/0175784 A1* 6/2016 Harmon ..... B01F 23/2132 366/167.1
2016/0332126 A1* 11/2016 Nande ..... B01F 23/21
2017/0152778 A1* 6/2017 Li ..... F01N 1/08
2020/0123955 A1* 4/2020 Liu ..... B01F 23/2132

FOREIGN PATENT DOCUMENTS

KR 10-2020-0055524 5/2020

* cited by examiner

*Primary Examiner* — Brandon D Lee
(74) *Attorney, Agent, or Firm* — MORGAN, LEWIS & BOCKIUS LLP

(57) ABSTRACT

A urea solution mixing chamber for a diesel vehicle that increases a purification rate of NOx by increasing a vaporization rate of a urea solution by use of a urea solution vaporization component, includes a flow guide configured to guide a flow of exhaust gas while collecting the flow of the exhaust gas toward a catalyst, a urea solution injector disposed rearward of the flow guide and configured to distribute and inject a urea solution, an impactor provided on an internal surface of the flow guide configured to collect the exhaust gas, the impactor being configured to atomize the urea solution injected from the urea solution injector, and vaporization fins configured to vaporize the atomized urea solution by bringing the atomized urea solution into contact with the vaporization fins and mix the vaporized urea solution with the exhaust gas.

17 Claims, 8 Drawing Sheets

UREA SOLUTION MIXING CHAMBER FOR DIESEL VEHICLE

CROSS REFERENCE TO RELATED APPLICATION

The present application claims priority to Korean Patent Application No. 10-2022-0067149, filed May 31, 2022, the entire contents of which is incorporated herein for all purposes by this reference.

BACKGROUND OF THE PRESENT DISCLOSURE

Field of the Present Disclosure

The present disclosure relates to a urea solution mixing chamber for a diesel vehicle that improves a purification rate of NOx by improving a vaporization rate of a urea solution by use of a urea solution vaporization component.

Description of Related Art

An SDPF (SCR) system is applied to meet the emission regulations related to diesel passenger vehicles that have become stricter. To remove nitrogen oxide (NOx), $NH_3$ is required as a reducing agent.

The $NH_3$ reducing agent is supplied through a urea solution (water with dissolved ammonia), and a uniform supply of the urea solution greatly affects NOx purification.

That is, because a slip of $NH_3$ occurs at a rear end portion of an SDPF catalyst when a large amount of urea solution is injected, an appropriate amount of urea solution needs to be injected at any time. If the flow uniformity of the urea solution is low, a large amount of urea solution is present in some places (a slip occurs), and a small amount of urea solution is present in other places (a purification rate of NOx is low), which causes a problem of a decrease in overall purification rate of NOx.

According to a result of evaluating operation conditions of an engine of a vehicle provided with the SDPF (SCR) system, it is not easy to achieve $NH_3$Ui (flow uniformity) with high efficiency.

This is because an excessive amount of injected urea solution cannot be sufficiently vaporized and the urea solution in a droplet state flows to the SDPF catalyst.

Therefore, there is a demand for a mixing chamber structure made by focusing on the vaporization of the urea solution to sufficiently vaporize a large amount of a urea solution.

The information included in this Background of the present disclosure is only for enhancement of understanding of the general background of the present disclosure and may not be taken as an acknowledgement or any form of suggestion that this information forms the prior art already known to a person skilled in the art.

BRIEF SUMMARY

Various aspects of the present disclosure are directed to providing a urea solution mixing chamber for a diesel vehicle that improves a purification rate of NOx by improving a vaporization rate of a urea solution by use of a urea solution vaporization component.

Various aspects of the present disclosure are directed to providing a urea solution mixing chamber for a diesel vehicle, the urea solution mixing chamber including: a flow guide configured to guide a flow of exhaust gas while collecting the flow of the exhaust gas toward a catalyst; a urea solution injector disposed rearward of the flow guide and configured to distribute and inject a urea solution into the flow guide; an impactor provided on an internal surface of the flow guide configured to collect the exhaust gas, the impactor being configured to atomize the urea solution injected from the urea solution injector; and vaporization fins configured to vaporize the atomized urea solution by bringing the atomized urea solution into contact with the vaporization fins and mix the vaporized urea solution with the exhaust gas.

The impactor may be formed in a plate shape and simultaneously atomize and vaporize the urea solution.

The impactor may have two plates provided in layers on the internal surface of the flow guide.

A plurality of injection holes including different injection angles may be formed in the urea solution injector, and the urea solution injected from the injection hole may be distributed to the respective plates of the at least two plates.

The urea solution injector may be provided at an upstream side of the impactor, and a second plate positioned to be relatively distant from the urea solution injector may be longer based on the upstream side than a first plate positioned to be relatively close to the urea solution injector.

A surface area of the second plate may be greater than a surface area of the first plate, and the amount of urea solution injected to the second plate may be greater than the amount of urea solution injected to the first plate.

A urea solution passing hole may be formed in the plate positioned to be close to the urea solution injector.

The urea solution injector and the impactor may be spaced apart from each other at a predetermined interval or more than the predetermined interval.

The urea solution mixing chamber may further include: an omega plate disposed at a rear end portion of the impactor and configured to swirl the exhaust gas mixed with the vaporized urea solution and supply the exhaust gas to the catalyst, in which the vaporization fins are provided in a plurality of layers on an internal surface of the omega plate that faces the impactor.

The vaporization fin may be provided at a downstream side of the impactor.

The impactor and the vaporization fin may be disposed in layers in the same direction.

The impactor may be provided in a direction parallel in a direction of an exhaust flow in the flow guide, and the vaporization fins may be disposed in layers in the direction of the exhaust flow on the omega plate.

An interval between the vaporization fins may be a predetermined interval or more than the predetermined interval.

A middle portion of an end portion of the impactor adjacent to the vaporization fins may be formed in a convex shape, and a middle portion of an end portion of the vaporization fin adjacent to the impactor may be formed in a concave shape.

A portion of the vaporization fin may be fixed to the omega plate, and the remaining portion of the vaporization fin may be disposed at a predetermined gap from the omega plate.

Two opposite end portions of the vaporization fin may be fixed to the omega plate, and a middle portion of the vaporization fin may be disposed at a predetermined gap from the omega plate.

According to an exemplary embodiment of the present disclosure described above, the urea solution injected from the urea solution injector is atomized and/or vaporized while coming into contact with the impactor and vaporized while coming into contact with the vaporization fins. Therefore, the urea solution is sufficiently vaporized even in a narrow space in the mixing chamber, which increases a vaporization rate of the urea solution.

Therefore, the vaporized urea solution and the exhaust gas are strongly mixed by a swirl flow made by the omega plate and then flow into the SDPF so that the high flow uniformity of $NH_3$ is achieved, increasing the purification rate of NOx.

The methods and apparatuses of the present disclosure have other features and advantages which will be apparent from or are set forth in more detail in the accompanying drawings, which are incorporated herein, and the following Detailed Description, which together serve to explain certain principles of the present disclosure.

Figure 1:
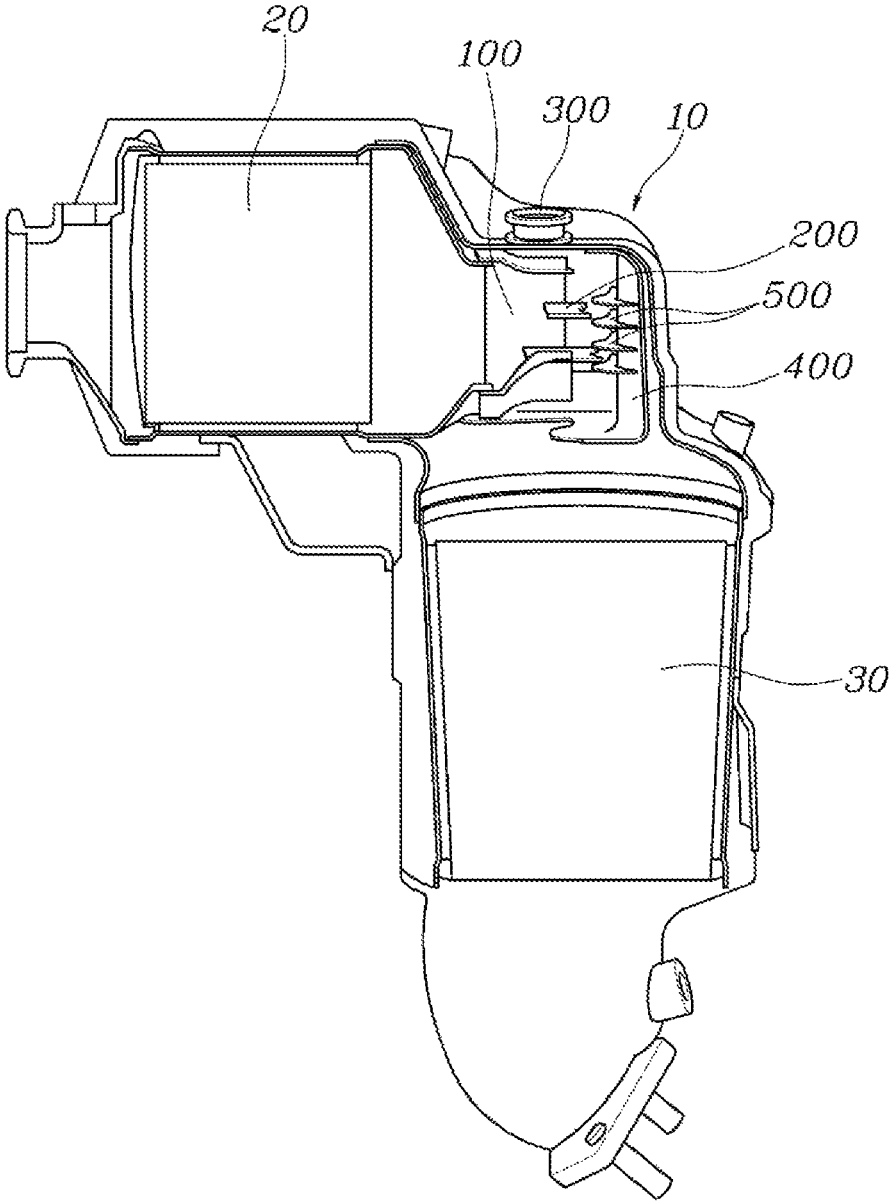
FIG. 1 is a cross-sectional view of an exhaust line to which a urea solution mixing chamber according to an exemplary embodiment of the present disclosure is applied.

It may be understood that the appended drawings are not necessarily to scale, presenting a somewhat simplified representation of various features illustrative of the basic principles of the present disclosure. The specific design features of the present disclosure as included herein, including, for example, specific dimensions, orientations, locations, and shapes will be determined in part by the particularly intended application and use environment.

In the figures, reference numbers refer to the same or equivalent parts of the present disclosure throughout the several figures of the drawing.

DETAILED DESCRIPTION

Reference will now be made in detail to various embodiments of the present disclosure(s), examples of which are illustrated in the accompanying drawings and described below. While the present disclosure(s) will be described in conjunction with exemplary embodiments of the present disclosure, it will be understood that the present description is not intended to limit the present disclosure(s) to those exemplary embodiments of the present disclosure. On the other hand, the present disclosure(s) is/are intended to cover not only the exemplary embodiments of the present disclosure, but also various alternatives, modifications, equivalents and other embodiments, which may be included within the spirit and scope of the present disclosure as defined by the appended claims.

Specific structural or functional descriptions of embodiments of the present disclosure included in the present specification or application are exemplified only for explaining the exemplary embodiments according to an exemplary embodiment of the present disclosure, the exemplary embodiments of the present disclosure may be carried out in various forms, and it should not be interpreted that the present disclosure is limited to the exemplary embodiments described in the present specification or application.

Because the exemplary embodiments of the present disclosure may be variously changed and may have various forms, specific embodiments will be illustrated in the drawings and described in detail in the present specification or application. However, the descriptions of the specific embodiments are not intended to limit embodiments according to the concept of the present disclosure to the specific embodiments, but it should be understood that the present disclosure covers all modifications, equivalents and alternatives falling within the spirit and technical scope of the present disclosure.

The terms such as "first" and/or "second" may be used to describe various constituent elements, but these constituent elements should not be limited by these terms. These terms are used only for distinguishing one constituent element from other constituent elements. For example, without departing from the scope according to the concept of the present disclosure, the first constituent element may be referred to as the second constituent element, and similarly, the second constituent element may also be referred to as the first constituent element.

When one constituent element is described as being "coupled" or "connected" to another constituent element, it should be understood that one constituent element may be coupled or directly connected to another constituent element, and an intervening constituent element can also be present between the constituent elements. When one constituent element is described as being "directly coupled to" or "directly connected to" another constituent element, it should be understood that no intervening constituent element is present between the constituent elements. Other expressions, that is, "between" and "just between" or "adjacent to" and "directly adjacent to", for explaining a relationship between constituent elements, should be interpreted in a similar manner.

The terms used in the present specification are used only for describing various exemplary embodiments and are not intended to limit the present disclosure. Singular expressions include plural expressions unless clearly described as different meanings in the context. In the present specification, it should be understood the terms "comprises," "comprising," "includes," "including," "containing," "has," "having" or other variations thereof are inclusive and therefore specify the presence of stated features, numbers, steps, operations, elements, components, or combinations thereof, but do not preclude the presence or addition of one or more other features, numbers, steps, operations, elements, components, or combinations thereof.

Unless otherwise defined, all terms used herein, including technical or scientific terms, have the same meaning as commonly understood by those skilled in the art to which an exemplary embodiment of the present disclosure pertains. The terms such as those defined in commonly used dictionaries should be interpreted as having meanings consistent with meanings in the context of related technologies and should not be interpreted as ideal or excessively formal meanings unless explicitly defined in the present specification.

Hereinafter, various exemplary embodiments of the present disclosure will be described in detail with reference to the accompanying drawings.

FIG. 1 is a cross-sectional view of an exhaust line to which a urea solution mixing chamber 10 according to an exemplary embodiment of the present disclosure is applied.

Referring to the drawings, a Lean NOx Trap (LNT) catalyst 20 is provided in an exhaust line, and the mixing chamber 10 according to an exemplary embodiment of the present disclosure is disposed at a downstream side of the LNT catalyst 20 so that exhaust gas passing through the LNT catalyst 20 flows into the mixing chamber 10.

Furthermore, an SDPF (SCR) catalyst 30 is disposed at a downstream side of the mixing chamber 10.

Furthermore, a urea solution is injected and vaporized in the mixing chamber 10, and the vaporized urea solution passes through the mixing chamber 10 and flows into the SDPF (SCR) catalyst 30 so that the SDPF (SCR) catalyst 30 removes NOx.

Figure 2:
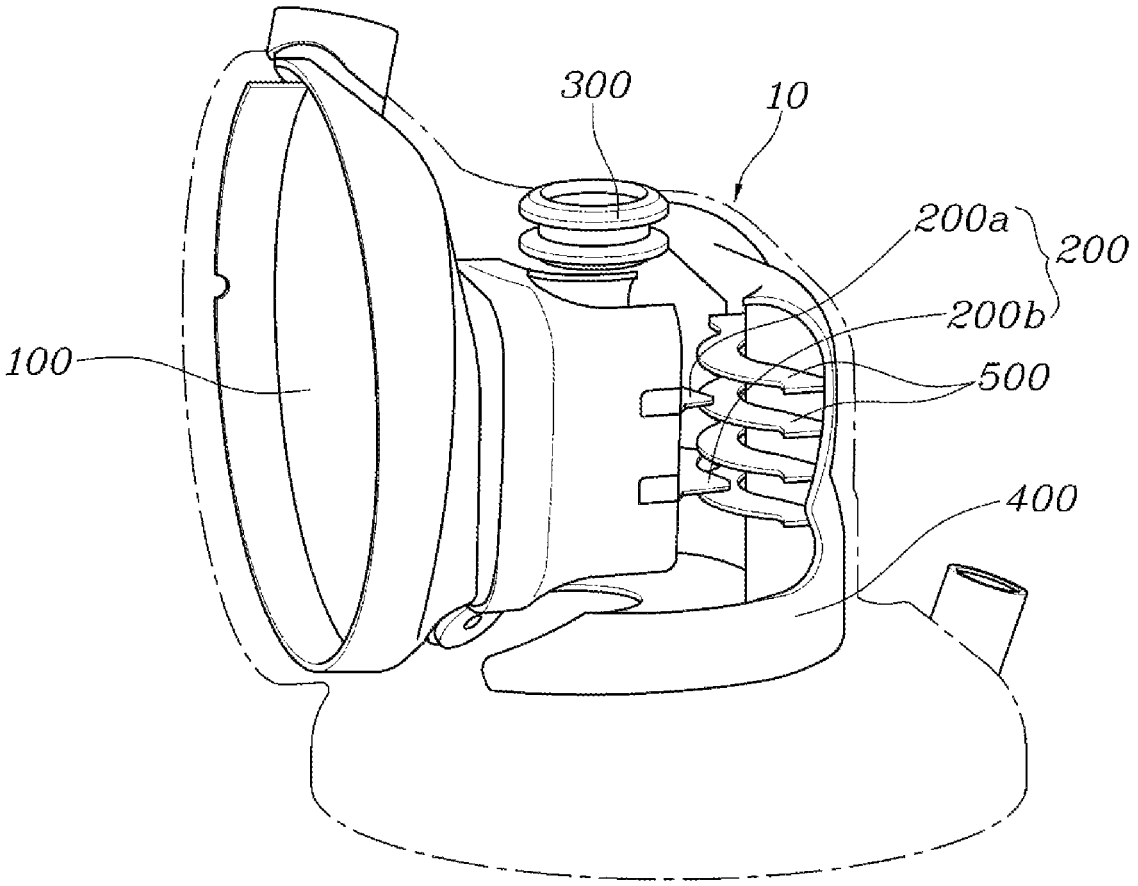
FIG. 2 is a projection view exemplarily illustrating an interior of the urea solution mixing chamber according to an exemplary embodiment of the present disclosure.
Figure 3:
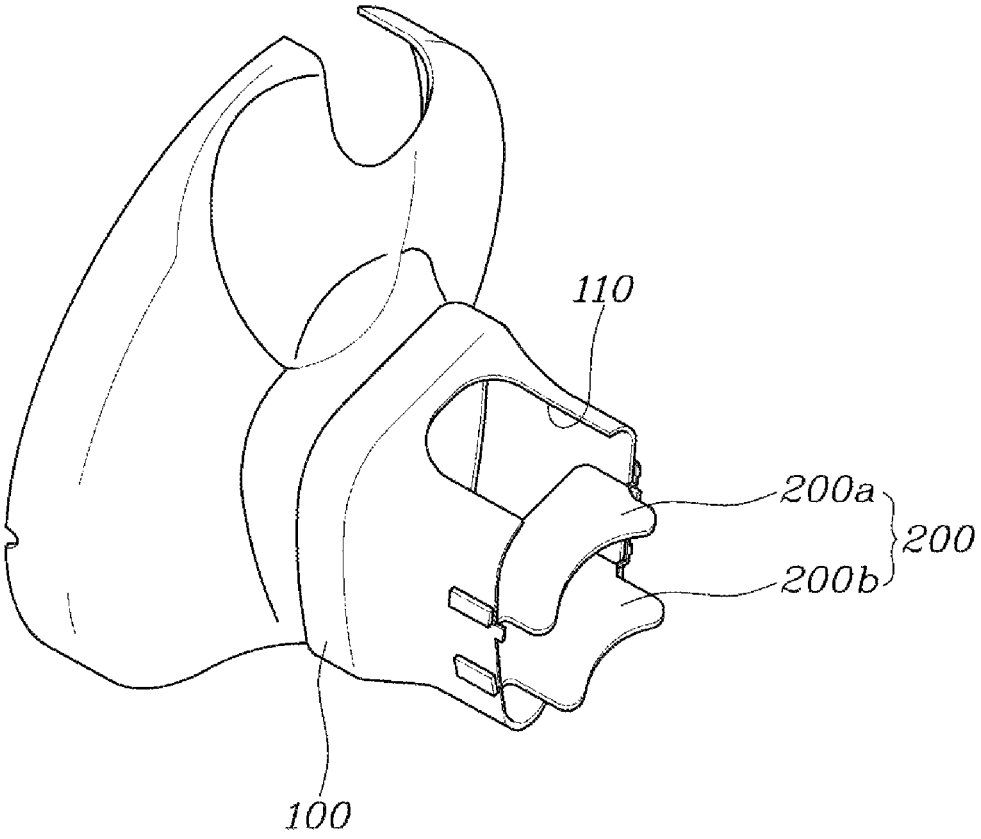
FIG. 3 is a view exemplarily illustrating a shape of a flow guide and a shape of an impactor according to an exemplary embodiment of the present disclosure.

Meanwhile, FIG. 2 is a projection view of an interior of the urea solution mixing chamber 10 according to an exemplary embodiment of the present disclosure, and FIG. 3 is a view exemplarily illustrating a shape of a flow guide 100 and a shape of an impactor 200 according to an exemplary embodiment of the present disclosure.

Referring to the drawings, the urea solution mixing chamber 10 according to various exemplary embodiments of the present disclosure may include the flow guide 100 configured to guide a flow of the exhaust gas while collecting the flow of the exhaust gas toward the catalyst; a urea solution injector 300 disposed rearward of the flow guide 100 and configured to distribute and inject the urea solution; impactors 200 provided on an internal surface of the flow guide 100 configured to collect the exhaust gas, the impactor 200 being configured to atomize the urea solution injected from the urea solution injector 300; and vaporization fins 500 configured to vaporize the atomized urea solution by bringing the atomized urea solution into contact with the vaporization fin and mix the vaporized urea solution with the exhaust gas.

For example, the catalyst is a catalyst including a selective catalytic function, may be an SDPF 30 made by coating a diesel particulate filter (DPF) with an SCR or be an SCR catalyst. The catalyst is disposed at the downstream side of the mixing chamber 10.

Furthermore, the flow guide 100 is fixed in a shape surrounded by an internal surface of a front end portion of the mixing chamber 10.

The flow guide 100 is formed in a horn shape having a cross-sectional flow area that gradually decreases from the upstream side to the downstream side. The exhaust gas flowing into the mixing chamber 10 is collected by the flow guide 100, and the collected exhaust gas is discharged to a rear end portion of the mixing chamber 10.

The impactor 200 has a flat plate shape. The impactor 200 includes two or more plates provided in layers and disposed at predetermined intervals on an internal surface of the flow guide 100.

In an exemplary embodiment of the present disclosure, the structure including two plates is provided. The two plates may include a first plate 200*a* and a second plate 200*b*.

Furthermore, the impactor 200 is fixed at a rear end portion of the flow guide 100. The two opposite left and right end portions of the impactor 200 are respectively fixed to left and right internal surfaces of the flow guide 100.

Furthermore, the urea solution injector 300 injects the urea solution, and the injected urea solution is distributed to the surfaces of the impactor 200 at a predetermined ratio.

Therefore, when the urea solution comes into contact with the impactor 200, the urea solution is atomized. Furthermore, the urea solution may be simultaneously atomized and vaporized.

The vaporization fins 500 vaporize the urea solution as the urea solution atomized by the impactor 200 comes into contact with the vaporization fins 500. The urea solution is thermally decomposed on the vaporization fins 500 and converted into ammonia.

For reference, a distribution ratio of the urea solution injected to the impactor 200 may be adjusted by controlling an injection angle and a shape of an injection hole 310 formed in the urea solution injector 300 and deforming a shape of the impactor 200. The present configuration will be described below.

That is, as described above, the urea solution injected from the urea solution injector 300 is atomized and/or vaporized while coming into contact with the plurality of impactors 200 and vaporized while coming into contact with the vaporization fins 500. Therefore, the urea solution is sufficiently vaporized even in a narrow space in the mixing chamber 10, which increases a vaporization rate of the urea solution.

Therefore, the vaporized urea solution and the exhaust gas are strongly mixed by a swirl flow made by an omega plate to be described below and then flow into the SDPF 30 so that the high flow uniformity of $NH_3$ is achieved, increasing the purification rate of NOx.

Meanwhile, in an exemplary embodiment of the present disclosure, as described above, the distribution ratio of the urea solution distributed to the impactor 200 may be determined depending on the injection angle of the injection hole 310 of the urea solution injector 300 through which the urea solution is injected.

Figure 5:
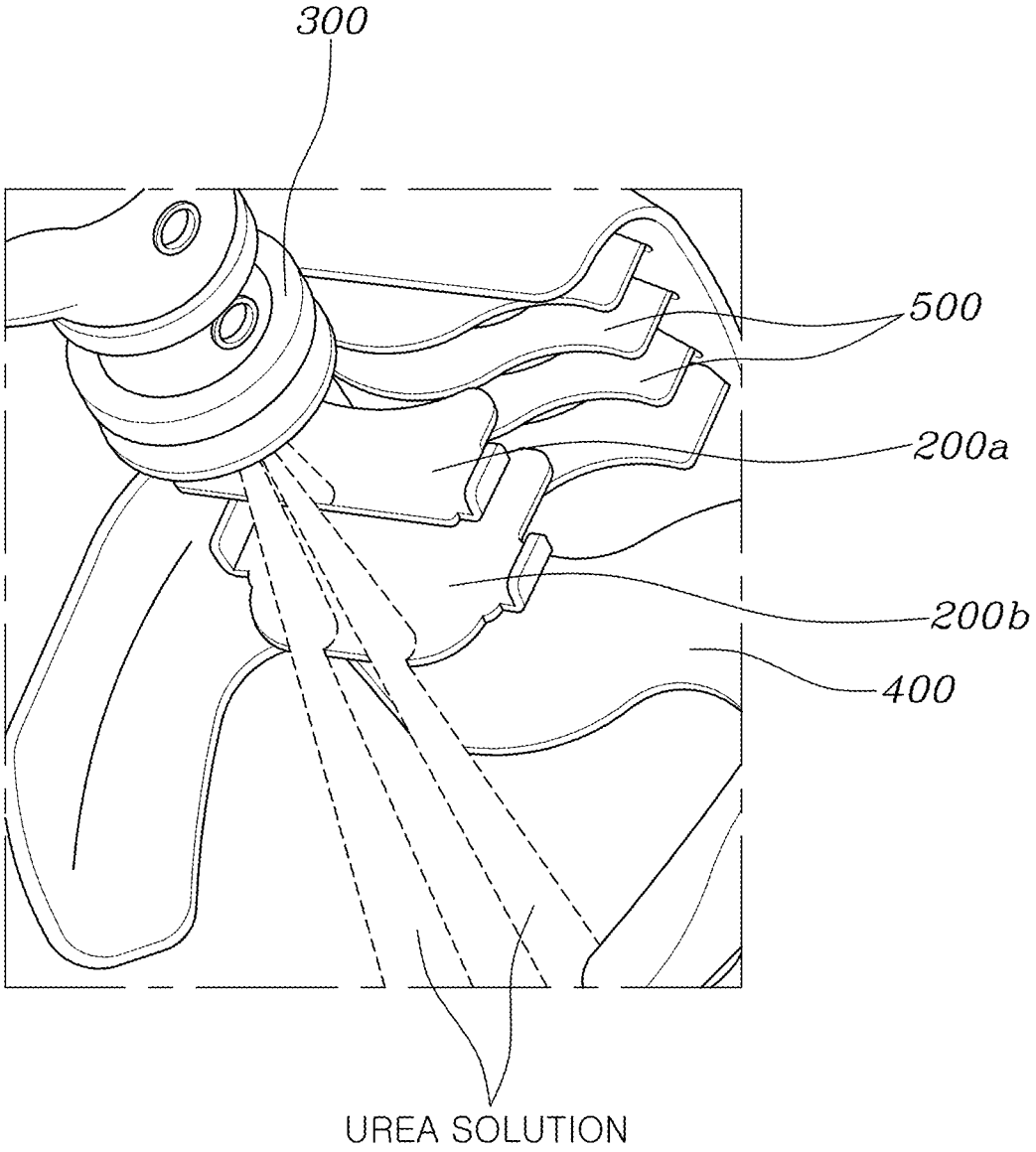
FIG. 5 is a view for explaining a configuration in which a urea solution is injected and distributed in the impactor according to an exemplary embodiment of the present disclosure.

FIG. 5 is a view for explaining a configuration in which the urea solution is distributed and injected to the impactor 200 according to an exemplary embodiment of the present disclosure. Referring to the drawing, a plurality of injection holes 310 including different injection angles is formed in the urea solution injector 300, and the urea solution injected from the injection holes 310 may be distributed to the respective plates of the at least two plates.

For example, the upper and lower plates forming the impactor in the drawing will be described as the first plate 200*a* and the second plate 200*b*.

Three injection holes 310 are formed in the urea solution injector 300, and the urea solution is injected through the respective injection holes 310. The injection holes 310 are each divided into three portions at an injection angle of 120°.

Therefore, the injection angles of the urea solution injected from the respective injection holes 310 are appropriately distributed so that the injection holes 310 are directed toward the first plate 200*a* and/or the second plate 200*b* so that the amount of urea solution distributed to the plates may be optimized.

Furthermore, referring to FIGS. 3 and 5, in an exemplary embodiment of the present disclosure, the urea solution injector 300 is provided at the upstream side of the impactor 200, and the second plate 200*b* positioned to be distant from the urea solution injector 300 may be longer based on the upstream side than the first plate 200*a* positioned to be close to the urea solution injector 300.

That is, the urea solution injector 300 is provided at an upper side of a front end portion of the first plate 200*a*, and the second plate 200*b* may be longer than the first plate 200*a* so that the urea solution is smoothly injected not only to the first plate 200*a* but also to the second plate 200*b*.

However, if the length of the first plate 200*a* is too short, a large amount of urea solution flows to the second plate 200*b*, which may decrease the vaporization rate. On the other hand, if the length of the first plate 200*a* is too long, the overall stream of the urea solution collides with the first plate 200*a* when the stream of the urea solution is bent by the flow of the exhaust gas, and thus no urea solution flows to the second plate 200*b*, which may decrease the vaporization rate. Therefore, it is necessary to appropriately design the lengths of the first and second plates 200*a* and 200*b*.

In the instant case, the first and second plates 200*a* and 200*b* are fixed in the flow guide 100, and an opening portion 110 including an open shape is formed in a portion of the flow guide 100 positioned between the first plate 200*a* and the urea solution injector 300 so that the urea solution may be smoothly injected to the impactor 200 without interference with the flow guide 100.

Therefore, in an exemplary embodiment of the present disclosure, a surface area of the second plate 200*b* may be greater than a surface area of the first plate 200*a*, and the amount of urea solution injected to the second plate 200*b* may be greater than the amount of urea solution injected to the first plate 200*a*.

If a large amount of urea solution is injected concentratedly to any one of the impactors 200, a temperature of a portion with which the urea solution comes into contact decreases so that the vaporization by the atomization cannot be sufficiently performed. Therefore, it is important to appropriately distribute the urea solution injected from the urea solution injector 300.

Therefore, in an exemplary embodiment of the present disclosure, the urea solution injected from one of the three injection holes 310 may be injected to the first plate 200*a*, and the urea solution injected from the remaining two injection holes 310 may be injected to the second plate 200*b*.

This is based on the configuration in which the surface area of the second plate 200*b* is greater than the surface area of the first plate 200*a*. The first plate 200*a* positioned at the upper side is targeted by the urea solution injected from one injection hole 310, and the second plate 200*b* positioned at the lower side is targeted by the urea solution injected from the two injection holes 310.

For reference, the position of the impactor 200 targeted by the urea solution needs to be designed so that the impactor 200 is targeted by 95% or more of the urea solution in a condition in which no exhaust gas flows.

Next, the distribution ratio of the urea solution distributed to the impactor 200 may be determined by deforming the shape of the impactor 200.

Figure 6A:
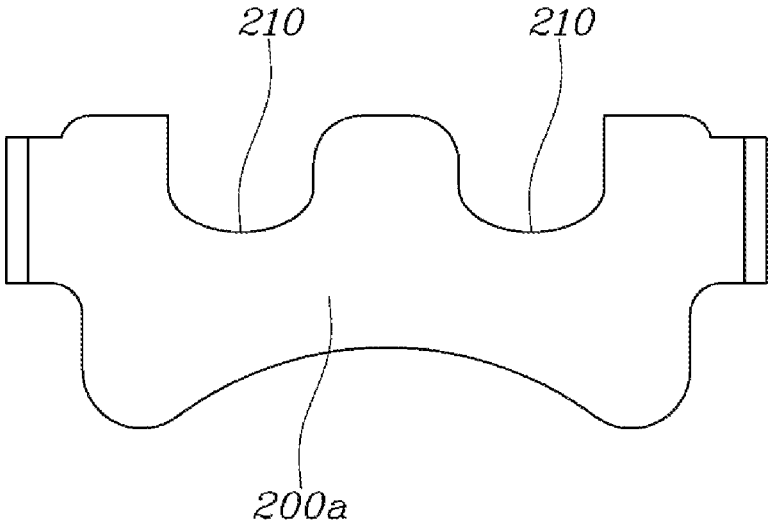
FIG. 6A and FIG. 6B are views exemplarily illustrating a state in which a urea solution passing hole is formed in the impactor according to an exemplary embodiment of the present disclosure.
Figure 6B:
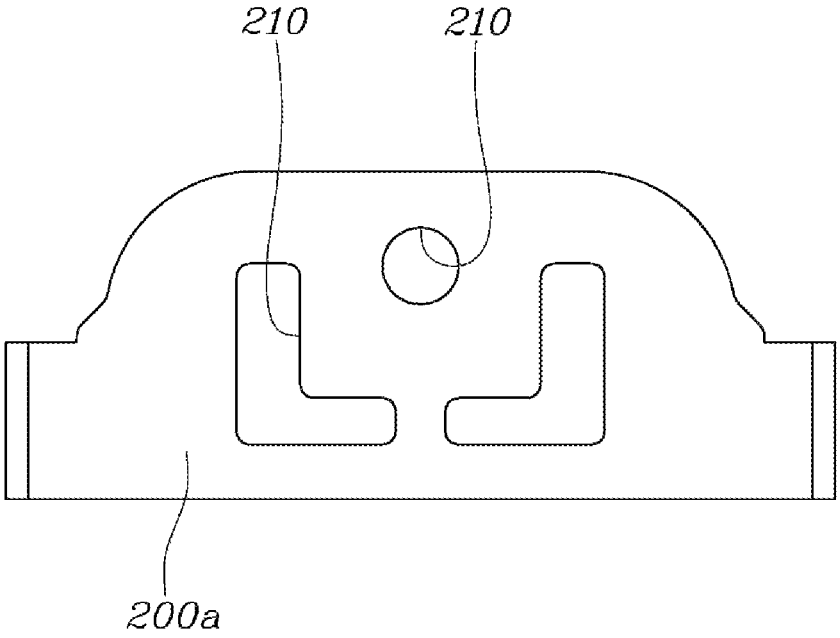

FIG. 6A and FIG. 6B are views exemplarily illustrating a state in which a urea solution passing hole 210 is formed in the impactor 200 according to an exemplary embodiment of the present disclosure.

Referring to the drawings, the urea solution passing hole 210 may be formed in the plate positioned close to the urea solution injector 300.

That is, as illustrated in the drawings, the hole is formed in the first plate 200*a* to reduce the amount of urea solution coming into contact with the first plate 200*a*. Therefore, it is possible to optimize the distribution of the urea solution injected from the first and second plates 200*a* and 200*b*.

Figure 7:
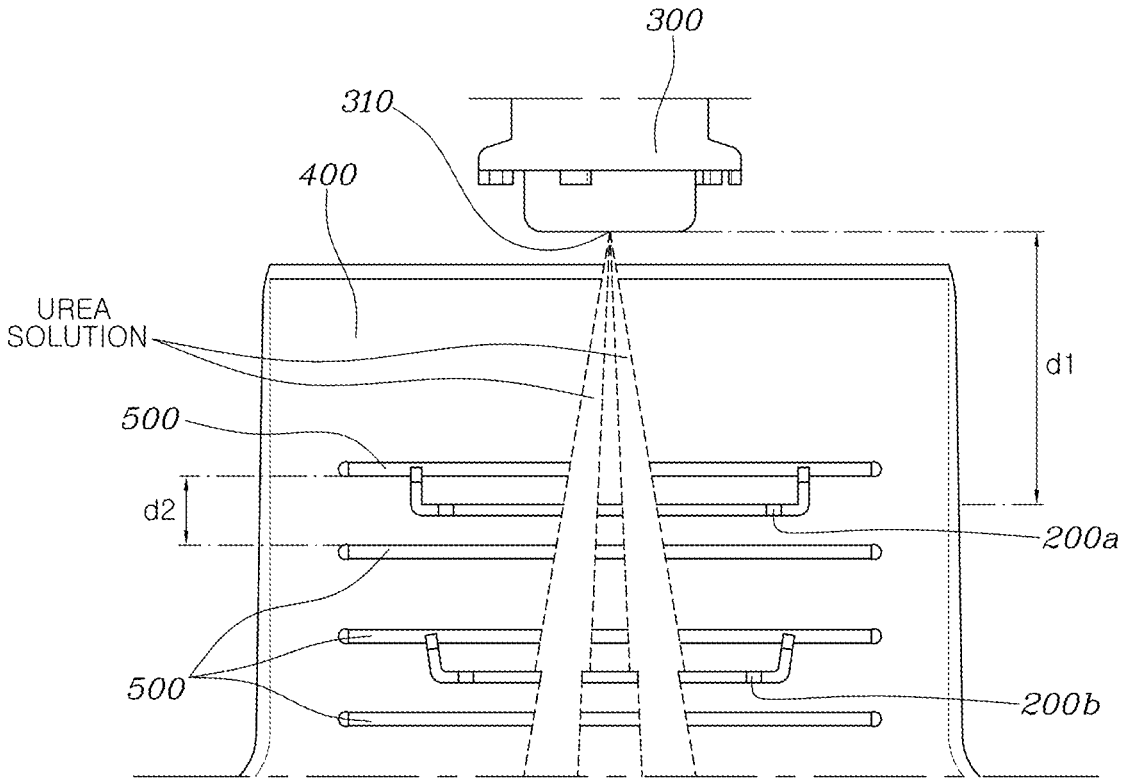
FIG. 7 is a view for explaining an arrangement interval between the impactor and a urea solution injector and an arrangement interval between the vaporization fins according to an exemplary embodiment of the present disclosure.

Meanwhile, FIG. 7 is a view for explaining an arrangement interval between the impactor 200 and the urea solution injector 300 and an arrangement interval between the vaporization fins 500 according to an exemplary embodiment of the present disclosure.

Referring to the drawings, in an exemplary embodiment of the present disclosure, the interval between the urea solution injector 300 and the impactor 200 may be regulated to a predetermined interval d1 or more.

For example, the first plate 200*a* and the injection hole 310 of the urea solution injector 300 are spaced from each other at the interval d1 of at least 35 mm or more.

That is, if an interval between the urea solution injector 300 and the first plate 200*a* is shorter than the interval d1, the urea solution injected to the first plate 200*a* may be rebounded and scattered back to the urea solution injector 300.

In the instant case, the urea solution may be crystallized, which may cause a quality problem that the urea solution injector 300 clogs the injection hole 310. Therefore, the interval between the urea solution injector 300 and the first plate 200*a* is set to a predetermined interval or larger.

Figure 4:
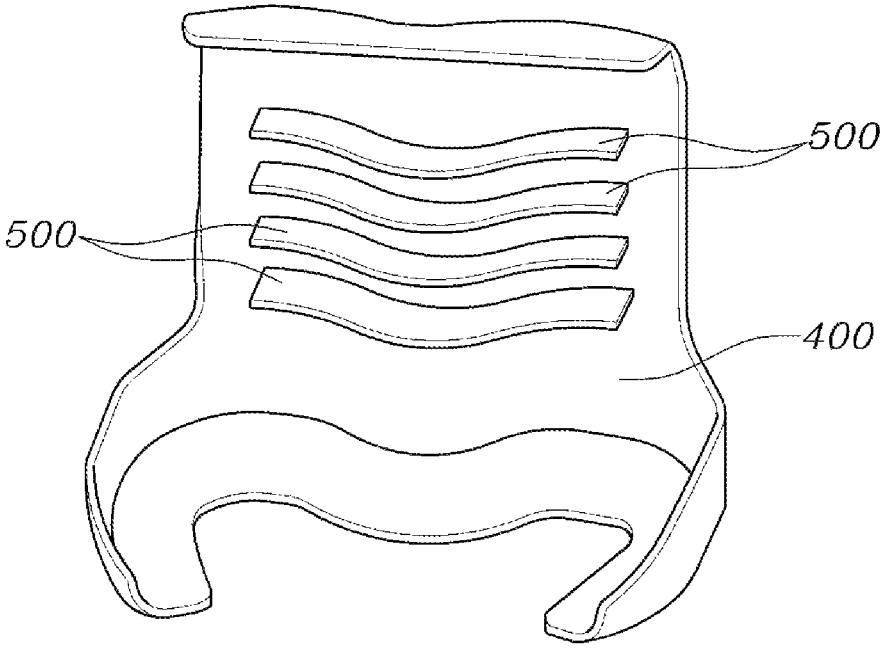
FIG. 4 is a view exemplarily illustrating a shape of an omega plate and shapes of vaporization fins according to an exemplary embodiment of the present disclosure.

Meanwhile, FIG. 4 is a view exemplarily illustrating a shape of the omega plate 400 and shapes of the vaporization fins 500 according to an exemplary embodiment of the present disclosure.

Referring to FIGS. 2 and 4, the mixing chamber according to an exemplary embodiment of the present disclosure further includes the omega plate 400 provided at the rear end portion of the impactor 200 and configured to swirl the exhaust gas mixed with the vaporized urea solution and supply the swirling exhaust gas to the catalyst.

Furthermore, the vaporization fins 500 may be provided in a plurality of layers on the internal surface of the omega plate 400 that faces the impactor 200.

For example, the vaporization fin 500 has a flat plate shape elongated in a leftward/rightward longitudinal direction. The vaporization fins 500 are provided at the downstream side of the impactor 200 and face the impactor 200.

Furthermore, the omega plate 400 is coupled in a shape surrounded by an internal surface of a rear end portion by the mixing chamber 10. The shape of the omega plate 400 generates a swirl flow that mixes the flow of the exhaust gas.

Therefore, the urea solution vaporized by the impactor 200 is mixed with the exhaust gas by the swirl flow generated by the omega plate 400. The exhaust gas mixed with the urea solution is discharged from the mixing chamber 10 in a direction of the exhaust flow and introduced into the SDPF 30.

That is, the urea solution injected from the urea solution injector 300 is vaporized by coming into contact with both the impactor 200 and the vaporization fins 500 facing the impactor 200 so that the urea solution is more sufficiently vaporized, further increasing the vaporization rate of the urea solution.

Therefore, the urea solution vaporized by the impactor 200 and the vaporization fins 500 is strongly mixed with the exhaust gas by the swirl flow made by the omega plate 400 and flows into the SDPF 30 so that the high flow uniformity of $NH_3$ is achieved, increasing the purification rate of NOx.

Furthermore, referring to FIGS. 2 and 7, the impactor 200 and the vaporization fins 500 may be disposed in layers in the same direction.

The impactor 200 is formed in the direction parallel to the direction of the exhaust flow in the flow guide 100. The vaporization fins 500 may be formed in a plurality of layers in the direction of the exhaust flow on the omega plate 400.

The two or more vaporization fins 500 may be disposed in layers in an upward/downward longitudinal direction of the omega plate 400.

Four vaporization fins 500 may be provided.

Furthermore, the interval between the vaporization fins 500 may be a predetermined interval d2.

That is, the number of applied vaporization fins 500 may be set depending on the interval between the vaporization fins 500, and the interval between the vaporization fins 500 may be set at a design level that allows the vaporization fins 500 to be welded.

In an exemplary embodiment of the present disclosure, the impactor 200 is provided at the front end portions of the vaporization fins 500 so that it is appropriate to set the interval between the vaporization fins 500 to 10 mm or more.

If the number of vaporization fins 500 is smaller than four, the urea solution cannot be sufficiently decomposed thermally, and the vaporization process is not smoothly performed. If the number of vaporization fins 500 is greater than four, the thermal decomposition of the urea solution is advantageously performed, but designed gaps in which the vaporization fins 500 are welded become narrower, which may cause a situation in which the urea solution cannot be discharged when the urea solution solidified.

Therefore, the interval between the vaporization fins 500 may be set to a predetermined interval d2 or larger depending on the number of vaporization fins 500.

For reference, in an exemplary embodiment of the present disclosure, the number of vaporization fins 500, the size of the vaporization fin 500, the number of impactors 200, and the size of the impactor 200 may of course be modified.

For example, when the urea solution collides with the vaporization fins 500 first instead of colliding with the impactor 200 first, the vaporization rate may be improved by increasing the number of vaporization fins 500.

Furthermore, the lengths in the leftward/rightward direction and/or the lengths in the width direction of the vaporization fins 500 may not be equal to one another but different from one another for the particular vaporization fins 500 or for the respective vaporization fins 500.

Furthermore, as illustrated in FIG. 5, in an exemplary embodiment of the present disclosure, a middle portion of an end portion of the impactor 200 adjacent to the vaporization fins 500 may be formed in a shape convex toward the vaporization fins 500, and a middle portion of an end portion of the vaporization fin 500 adjacent to the impactor 200 may be formed in a shape concave toward the impactor 200.

That is, the middle portions of the vaporization fins 500 and the impactor 200, which face one another, are formed in the concave and convex arc shapes corresponding to one another. Therefore, the urea solution injected from the urea solution injector 300 is prevented from being discharged through the gaps between the vaporization fins 500 and the impactor 200. Therefore, the vaporization rate of the urea solution is further improved.

Figure 8:
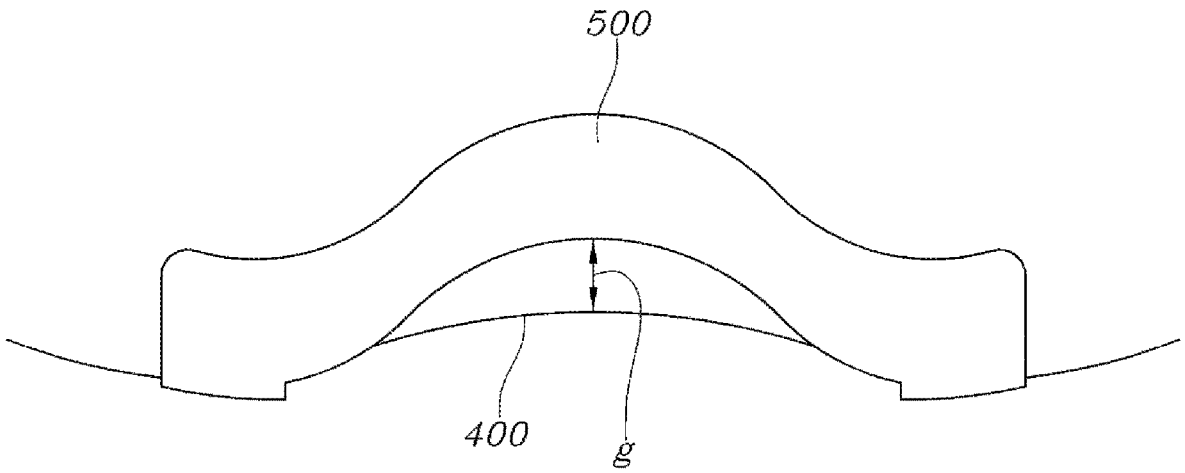
FIG. 8 is a view for explaining a structure for fixing the omega plate and the vaporization fins according to an exemplary embodiment of the present disclosure.

Therefore, FIG. 8 is a view for explaining a structure for fixing the omega plate 400 and the vaporization fins 500 according to an exemplary embodiment of the present disclosure.

Referring to the drawings, a portion of the vaporization fin 500 may be fixed to the omega plate 400, and the remaining portion of the vaporization fin 500 may be provided at the predetermined gap g from the omega plate 400.

Two opposite end portions of the vaporization fin 500 may be fixed to the omega plate 400, and the middle portion of the vaporization fin 500 may be provided at the predetermined gap g from the omega plate 400.

That is, the vaporization fin 500 may be fixed to the omega plate 400 by welding. However, a portion of the vaporization fin 500, except for the portion of the vaporization fin 500 fixed to the omega plate 400, needs to have a gap from the omega plate 400.

This is because urea solution solidified materials such as biuret, cyanuric acid, and melamine may be produced by a side reaction of the urea solution when the urea solution cannot be vaporized, but the urea solution is consistently injected in a droplet state.

Because the solidified materials cause various problems such as the interruption of vaporization of the urea solution, it is necessary to prevent crystallization and/or solidification of the urea solution.

The gap g between the vaporization fin 500 and the omega plate 400 may be set to a level of 1.7 mm.

As described above, in an exemplary embodiment of the present disclosure, the urea solution injected from the urea solution injector 300 is atomized and/or vaporized while coming into contact with the impactor 200 and vaporized while coming into contact with the vaporization fins 500. Therefore, the urea solution is sufficiently vaporized even in a narrow space in the mixing chamber 10, which increases a vaporization rate of the urea solution.

Therefore, the vaporized urea solution and the exhaust gas are strongly mixed by a swirl flow made by the omega plate 400 and then flow into the SDPF 30 so that the high flow uniformity of $NH_3$ is achieved, increasing the purification rate of NOx.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present disclosure have been presented for purposes of illustration and description. They are not intended to be exhaustive or to limit the present disclosure to the precise forms disclosed, and obviously many modifications and variations are possible in light of the above teachings. The exemplary embodiments were chosen and described to explain certain principles of the present disclosure and their practical application, to enable others skilled in the art to make and utilize various exemplary embodiments of the present disclosure, as well as various alternatives and modifications thereof. It is intended that the scope of the present disclosure be defined by the Claims appended hereto and their equivalents.

What is claimed is:

1. A urea solution mixing apparatus for a vehicle, the urea solution mixing apparatus comprising:

a flow guide configured to guide a flow of exhaust gas while collecting the flow of the exhaust gas toward a catalyst;

a urea solution injector disposed rearward of the flow guide and configured to distribute and inject a urea solution into the flow guide;

an impactor provided on an internal surface of the flow guide configured to collect the exhaust gas, the impactor being configured to atomize the urea solution injected from the urea solution injector; and at least a vaporization fin configured to vaporize the atomized urea solution by bringing the atomized urea solution into contact with the at least a vaporization fin and mix the vaporized urea solution with the exhaust gas, wherein a middle portion of an end portion of the impactor adjacent to the at least a vaporization fin is formed in concave, and a middle portion of an end portion of the at least a vaporization fin adjacent to the impactor is formed in convex.

2. The urea solution mixing apparatus of claim 1, wherein the impactor is formed in a shape of a plate and simultaneously atomizes and vaporizes the urea solution.

3. The urea solution mixing apparatus of claim 1, wherein the impactor includes at least two plates provided in layers on the internal surface of the flow guide.

4. The urea solution mixing apparatus of claim 3, wherein a plurality of injection holes is formed in the urea solution injector, and the urea solution injected from the injection holes is distributed to respective plates of the at least two plates.

5. The urea solution mixing apparatus of claim 3, wherein the at least two plates include a first plate and a second plate, and wherein the urea solution injector is provided at an upstream side of the impactor, and the second plate positioned to be relatively distant from the urea solution injector is longer than the first plate positioned to be relatively close to the urea solution injector.

6. The urea solution mixing apparatus of claim 5, wherein a surface area of the second plate is greater than a surface area of the first plate, and an amount of the urea solution injected to the second plate is greater than an amount of the urea solution injected to the first plate.

7. The urea solution mixing apparatus of claim 5, wherein a urea solution passing hole is formed in the first plate positioned to be close to the urea solution injector.

8. The urea solution mixing apparatus of claim 5, wherein an opening portion is formed in a portion of the flow guide positioned between the first plate and the urea solution injector so that the urea solution is injected to the impactor without interference with the flow guide.

9. The urea solution mixing apparatus of claim 3, wherein a urea solution passing hole is formed in a plate positioned to be close to the urea solution injector, among the at least two plates.

10. The urea solution mixing apparatus of claim 1, wherein the urea solution injector and the impactor are spaced apart from each other at a predetermined interval or more than the predetermined interval.

11. The urea solution mixing apparatus of claim 1, further including:

an omega plate disposed at a rear end portion of the impactor and configured to swirl the exhaust gas mixed with the vaporized urea solution and supply the exhaust gas to the catalyst, wherein the at least a vaporization fin is in plural, and wherein the vaporization fins are provided in a plurality of layers on an internal surface of the omega plate that faces the impactor.

12. The urea solution mixing apparatus of claim 1, wherein the at least a vaporization fin is provided at a downstream side of the impactor.

13. The urea solution mixing apparatus of claim 1, wherein the impactor and the at least a vaporization fin are disposed in layers in a same direction.

14. The urea solution mixing apparatus of claim 11, wherein the impactor is provided in a direction parallel in a direction of an exhaust flow in the flow guide, and the vaporization fins are disposed in layers in the direction of the exhaust flow on the omega plate.

15. The urea solution mixing apparatus of claim 1, wherein the at least a vaporization fin is in plural, and wherein an interval between the vaporization fins is a predetermined interval or more than the predetermined interval.

16. The urea solution mixing apparatus of claim 11, wherein a portion of the at least a vaporization fin is fixed to the omega plate, and a remaining portion of the at least a vaporization fin is disposed at a predetermined gap from the omega plate.

17. The urea solution mixing apparatus of claim 11, wherein first and second opposite end portions of the at least a vaporization fin are fixed to the omega plate, and a middle portion of the at least a vaporization fin is disposed at a predetermined gap from the omega plate.

* * * * *